United States Patent [19]

Baumann et al.

[11] 4,106,893

[45] Aug. 15, 1978

[54] SINTERING FURNACE

[75] Inventors: Helmut Baumann; Fritz Petzi, Nüremberg, both of Fed. Rep. of Germany

[73] Assignee: Ludwig Riedhammer GmbH & Co. K.G., Nüremberg, Fed. Rep. of Germany

[21] Appl. No.: 771,444

[22] Filed: Feb. 24, 1977

[30] Foreign Application Priority Data

Dec. 23, 1976 [DE] Fed. Rep. of Germany ..... 2658489

[51] Int. Cl.[2] ..... F27D 15/02; F27B 9/26

[52] U.S. Cl. ..... 432/77; 432/137; 432/153

[58] Field of Search ..... 432/77, 137, 138, 153, 432/154

[56] References Cited

U.S. PATENT DOCUMENTS

| | | | |
|---|---|---|---|
| 1,416,727 | 5/1922 | McDougal | 432/137 |
| 1,613,054 | 1/1927 | Prouty et al. | 432/153 |
| 2,736,943 | 3/1956 | Cremer | 432/137 X |
| 2,928,158 | 3/1960 | Miller | 266/260 X |
| 3,168,299 | 2/1965 | Miller | 432/137 X |
| 3,957,111 | 5/1976 | Kobayashi et al. | 432/77 |

*Primary Examiner*—John J. Camby

*Attorney, Agent, or Firm*—Ross, Ross & Flavin

[57] ABSTRACT

A sintering furnace for sintering magnetic-ceramic articles is in the form of a quick-firing carriage furnace having a cooling system for indirect cooling in a cooling zone, having a sluice chamber at its outlet-end and being gastight at its base.

1 Claim, 5 Drawing Figures

SINTERING FURNACE

FIELD OF THE INVENTION

This invention relates to a sintering furnace for sintering magnetic-ceramic articles.

DESCRIPTION OF THE PRIOR ART

In the past magnetic-ceramic articles have been fired chiefly in a plate push-through furnace, possibly also in a lifting beam furnace. The need now exists, upon the sintering of ferrites, more especially soft ferrites, to increase production. In order to achieve this, using the previously used plate push-through furnaces, the length thereof would have to be increased. However, technical limits are set on such a lengthening. Thus the problem exists of increasing the production upon the sintering of ferrites, more especially of soft ferrites, without having to lengthen the plate push-through furnaces.

As a tunnel furnace of high capacity, the rapid-fire carriage furnace has proved its worth. In this furnace, carriages form conveying means for the articles to be treated in the furnace. The carriages have a metallic underframe and a plate-like heat-insulating layer, consisting of heat insulation material, mounted thereon. Mounted on the underframe are metallic sliding runners by means of which the carriages are shifted in sliding manner on metallic rails inside the furnace.

Carriage furnaces having a furnace channel which is completely closed on the jacket side cannot, of course, be used where temperatures over 950° C prevail. Nevertheless, in order to be able to use carriage furnaces for higher temperatures, it has been known to keep the furnace open on the underside. In this way cooling air passes from the environment of the furnace onto the underside of the carriages as well as onto the sliding runners and the rails. Practice shows that with such a carriage furnace ceramic plates, more especially in single-layer arrangement, on the carriages can be fired in a relatively short time at temperatures lying considerably above 950° C.

The known carriage furnace, which has a relatively high goods throughput, is unusable for sintering ferrites, of course, despite the high temperatures that can be achieved and despite the high throughput. This is above all because the known high-temperature carriage furnace is open at the base, so that the protective gas atmosphere necessary for sintering the ferrites cannot be produced and maintained inside the furnace.

From the development of the high-temperature carriage furnaces an expert is conversant with the fact that by closing the furnace floor — which would be the first prerequisite for the possibility of using this furnace for producing and maintaining the protective gas atmosphere — the temperature underneath the carriages so rises that the use of metallic sliding elements is impossible.

BRIEF DESCRIPTION OF THE INVENTION

The invention provides a sintering furnace for sintering of magnetic-ceramic articles, comprising a quick-firing carriage furnace having a cooling system for indirect cooling in a cooling zone C and having a sluice chamber 4 at its outlet end and being gastight at its base.

Tests have shown that through the modification, in accordance with the invention, of the known carriage furnace in actual fact a furnace is provided which makes it possible to sinter ferrites, more especially soft ferrites, in a desired gas atmosphere extremely rapidly, so that a higher productivity emerges than was previously possible. The run-through times can be kept so short because the carriages withstand high temperature changes in short periods of time, which is not the case with regard to the thrust (or push) plates in the case of plate push-through furnaces. It has thus become apparent that the measures in accordance with the invention are completely sufficient, despite the necessary high sintering temperatures and despite the gastight design of the furnace floor, for the metallic conveying elements (sliding runners and rails) not to experience any excessive heating and accordingly for them to remain completely functionable. Of course, it can possibly also still be advisable to cool the furnace floor in the sintering zone.

In order to achieve the gastightness on the base side of the furnace, advantageously the furnace is given a continuous floor which is, for its parts, gastight. In some cases it can, of course, also be advantageous to form the base-side sealing directly by means of the carriage base. In this case the furnace channel itself could — as in the case of the known high-temperature carriage furnace — even remain open at the base.

It is additionally of advantage if the indirect cooling system in the cooling zone is split up into several sections. These can then in case of need selectively be charged with different cooling agents.

BRIEF DESCRIPTION OF THE DRAWINGS

Further object and advantages of the invention will become apparent from the accompanying drawings, in which.

DESCRIPTION OF A PREFERRED EMBODIMENT

A preferred carriage furnace in accordance with the invention has a preheating zone A, a high-temperature zone B and a cooling zone C. The articles to be sintered are conveyed from the inlet side 1 in the direction of the arrow D through the furnace channel 2 by means of the carriages 3. These are pushed, in a manner which is not shown, from the inlet side 1 through the furnace channel 2. In this respect they pass initially into the preheating zone A, then into the high-temperature zone B and finally into the cooling zone C. Before they leave the furnace, they must additionally pass through a sluice chamber 4 arranged expressly for this purpose. This sluice chamber is periodically flushed with protective gas. Moreover, nitrogen is conducted into the furnace channel 2 from the outlet side at E and F.

Figure 1:
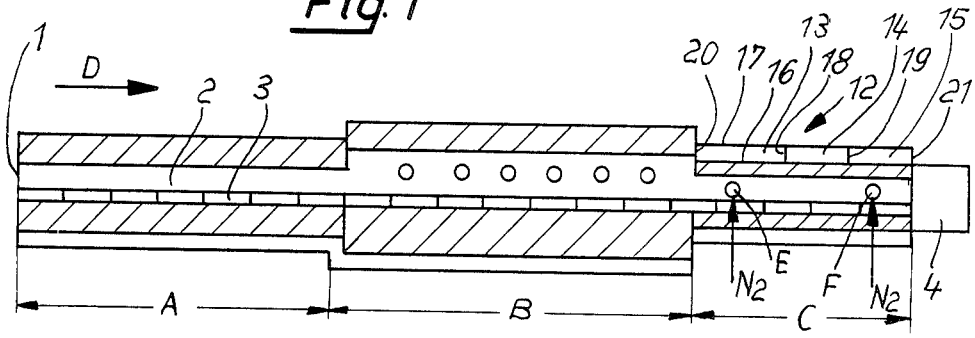
FIG. 1 shows a preferred carriage furnace of the invention in longitudinal section.
Figure 2:
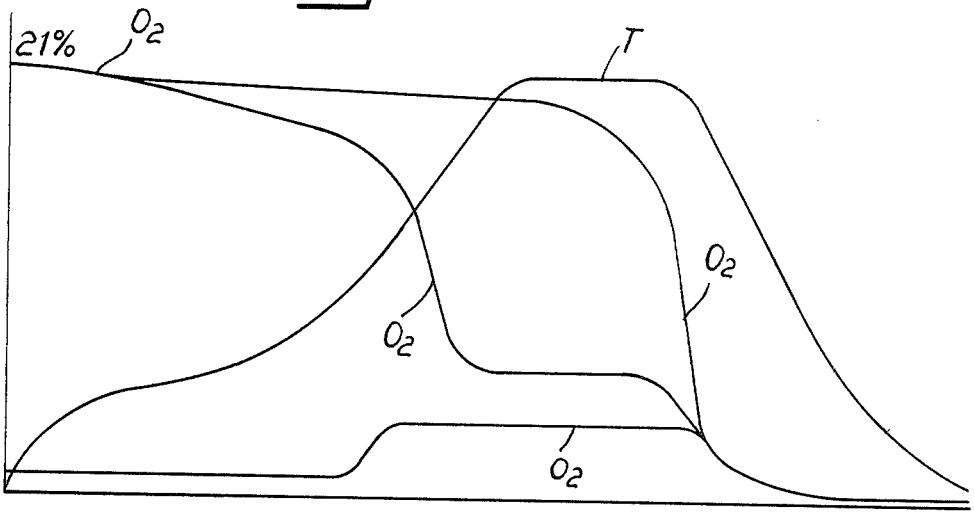
FIG. 2 is a diagram from which the range of temperature within the furnace along its extent is evident and from which it additionally emerges that the adjustment of gas atmospheres having a widely different oxygen content along the extent of the furnace is possible.

In the embodiment in accordance with FIG. 1, the furnace is provided with a closed base or floor 5 which is gastight. Mounted on the floor 5 are rails 6 and 7 which extend along the entire length of the furnace inside the furnace channel 2. These rails 6 and 7 are of metal. On them the carriages 3 rest with their sliding runners 8 and 9. Consequently the carriages 3 can be conveyed in the direction of the arrow D in sliding manner through the furnace channel 2.

The carriages 3 have, on the underside, a metallic frame 10, on which a plate-shaped insulating layer 11 is mounted.

In the cooling zone C the furnace is provided with an indirect cooling system 12, which is split up into several sections. Three such sections are indicated in the drawings. They are designated by 13, 14 and 15. The individual sections are in the present case formed by double jackets, closed at the front side, consisting of the jackets 17 and 16, which are cut off from one another by the dividing walls 18 and 19 and are sealed at the front ends by the end walls 20 and 21. The sections can extend right around the tunnel furnace. They can, however, also possibly reach only as far as the tunnel furnace floor.

Figure 4:
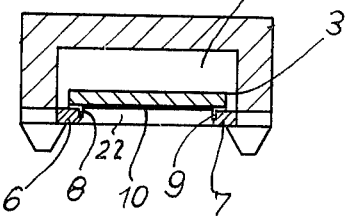
FIG. 4 shows a further cross-section through a modified tunnel furnace in which the base is open.
Figure 3:
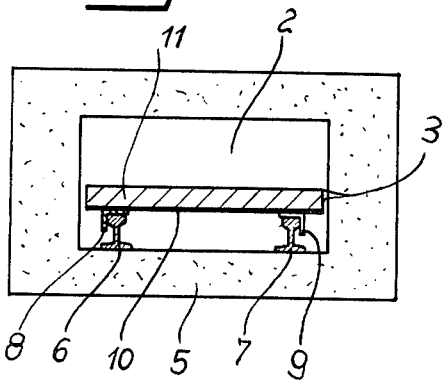
FIG. 3 is a cross-section through the tunnel furnace of FIG. 1.
Figure 5:
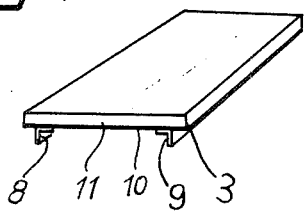
FIG. 5 shows a diagrammatic reproduction of a carriage of the furnace, schematically.

In the case of the embodiment in accordance with FIG. 4, the furnace channel 2 is open at its underside at 22. Here the carriages 3 themselves form the gastight seal towards the floor-free point 22.

In some instances it can, circumstances permitting, be of advantage if additionally cooling is effected in the sintering zone (high-temperature zone B) underneath the carriage 3.

We claim:

1. A sintering furnace for sintering magnetic-ceramic articles comprising:

a rapid-firing carriage furnace structure having a gastight flooring;

an inlet at one end and an outlet at the other end of the structure;

means defining a plural-section cooling zone in the interior of the structure;

cooling means for effecting indirect cooling of the cooling zone with additional cooling in the section of highest temperature;

rails extending longitudinally of the structure along a lower part thereof;

carriages mounted for sliding movement along the rails;

means for selectively charging different ones of the sections of the plurality thereof in the cooling zone with different cooling media.

* * * * *